US005671159A

United States Patent [19]

Morita

[11] Patent Number: 5,671,159

[45] Date of Patent: Sep. 23, 1997

[54] FIRE DETECTING APPARATUS

[75] Inventor: Toshikazu Morita, Tokyo, Japan

[73] Assignee: Nohmi Bosai Ltd., Tokyo, Japan

[21] Appl. No.: 346,229

[22] Filed: Nov. 22, 1994

[30] Foreign Application Priority Data

Nov. 25, 1993 [JP] Japan ..... 5-295668

[51] Int. Cl.[6] ..... G08B 17/00; G08B 29/18

[52] U.S. Cl. ..... 364/550; 364/551.01; 364/557; 364/574; 340/587; 356/433

[58] Field of Search ..... 340/566, 511, 340/514, 583, 584, 587, 588, 622, 628, 630; 324/71.1; 356/341, 343, 434, 438, 436; 364/550, 551.01, 557, 524

[56] References Cited

U.S. PATENT DOCUMENTS

| | | | |
|---|---|---|---|
| 4,679,156 | 7/1987 | Kern et al. | 364/551.01 |
| 4,695,734 | 9/1987 | Honma et al. | 340/630 X |
| 4,803,469 | 2/1989 | Matsushita | 340/557 |
| 4,884,222 | 11/1989 | Nagashima et al. | 364/550 |
| 5,237,512 | 8/1993 | Davidson | 364/487 |

FOREIGN PATENT DOCUMENTS

| | | |
|---|---|---|
| 0 067 339 | 12/1982 | European Pat. Off. . |
| 2 542 116 | 9/1984 | France . |
| 35 29 344 | 2/1986 | Germany . |

OTHER PUBLICATIONS

1991 IEEE International Carnahan Conference on Security Technology, Oct. 3, 1991, G. Pfister, pp. 253–260, "Trends Toward the Optimum Danger Detection System".

*Primary Examiner*—James P. Trammell
*Assistant Examiner*—Kamini S. Shah
*Attorney, Agent, or Firm*—Wenderoth, Lind & Ponack

[57] ABSTRACT

A fire detecting apparatus is designed to have improved reliability by reducing the possibility that the apparatus is influenced by an environmental change, external noise or the like which would otherwise cause erroneous fire information to be sent to a receiving unit to generate a false alarm. The apparatus includes a light emitting device for detecting a physical quantity of a fire phenomena such as smoke, a light receiving device, an A/D conversion circuit, a RAM for successively storing a predetermined number of latest detection outputs from the A/D conversion circuit, an MPU for calculating deviations between the predetermined number of latest detection outputs stored in the RAM and for calculating an average value of at least two of the detection outputs having the smallest deviation, and a transmitting/receiving circuit for sending the average value calculated by the MPU as a physical quantity of the fire phenomenon,

9 Claims, 6 Drawing Sheets

START
SET INITIAL VALUES
S1
2
S2
SIGNAL RECEPTION ?
NO
YES
S3
CALLED ?
NO
YES
S4
SUM CHECK OK ?
NO
YES
S5
DETECTION DATA RETURN INSTRUCTION ?
YES
NO
S6
PERFORM PROCESSING CORRESPONDING TO RECEPTION INSTRUCTION
S7
READ DATA CODE FROM STORAGE AREA 73
S8
FORM SUM CHECK CODE
S9
SEND DATA CODE AND SUM CHECK CADE
1

FIRE DETECTING APPARATUS

BACKGROUND OF THE INVENTION

1. Field of the Invention

This invention relates to a fire detecting apparatus and, more particularly, to a fire detecting apparatus capable of transmitting information denoting a physical quantity (e.g., analog quantity) of a detected fire phenomenon such as smoke, heat, light of fire, gas, smell, etc., to a receiving section of a fire receiver, a relay unit or the like.

2. Description of the Related Art

Conventionally, an analog type photoelectric fire detector having a smoke detection chamber, a light emitting element and a light receiving element incorporated therein is known as this kind of fire detecting apparatus. The detector detects a physical quantity of smoke in response to a light emitting control signal which is output at predetermined time intervals (e.g., three seconds) from a built-in clock device such as a timer, or when it receives a polling signal which is sent from a receiving unit to call the detector at the predetermined time intervals (e.g., three seconds). The detector then converts a signal related to the physical quantity into a digital signal, for example, and sends this signal to the receiving unit. (See, for example, Japanese Patent Laid-Open No. 249299/1987).

There have been proposed other types of conventional fire detecting apparatuses, e.g., an analog thermal-type fire detector using a thermal element in a measuring circuit section for measuring a temperature or the like, an analog ionization-type fire detector having an ion chamber with a plurality of internal electrodes in a measuring circuit section for measuring the density of smoke or the like. Operating power is supplied to the measuring circuit section and an output circuit section of these types of detectors only when a match occurs between an address signal input via a transmission line and an address assigned to the detector. (See, for example, Japanese Utility Model Laid-Open No. 178794/1984.)

The conventional fire detecting apparatuses, arranged as described above, suffer the following problem. For example, in the case of a photoelectric type fire detector, the light receiving element of the detector may detect external light noise such as a camera strobe light during a smoke detecting operation, or induced noise may be superimposed on the light receiving output. A noise signal component caused by such noise is sent to the light receiving unit as a physical quantity. As a result, the receiving unit mistakenly determines the occurrence of fire although there is actually no fire, thus generating a false alarm.

In the case of a thermal-type fire detector, if the detector is disposed in the vicinity of an air outlet of an air conditioner or in a cookroom, the thermal element easily affected thermally by a change in the air flow rate, steam generated or the like. Also, external noise can be easily superimposed on an external lead wire of the thermal element or the like. In such a situation, the receiving unit may mistakenly determine the occurrence of fire based on an output from the detector, although there is no fire, thus generating a false alarm, as described above.

Further, in the case of an ionization-type fire detector, a mere smoke or the like not resulting from actual fire or a change in an environmental factor such as an air flow in a space where the detector is disposed can easily influence the detector in such a manner that the resistance between electrodes of the detector varies. Also, external noise can easily be superimposed on an output signal from the detector because the impedance of a switching device connected to an intermediate electrode of the detector is high. It is therefore possible that the receiving unit will mistakenly determine the occurrence of fire based on the output from the detector, although there is no fire, thus generating a false alarm, as described above.

SUMMARY OF THE INVENTION

In view of the above problems, an object of the present invention is to provide a reliable fire detecting apparatus which is not affected by changes in any environmental factors or by external noise which would otherwise cause erroneous fire information to be sent to the receiving unit to generate a false alarm.

To achieve the above object, according to the present invention, there is provided a fire detecting apparatus comprising detection means for detecting a physical quantity of a fire phenomenon, storage means for successively storing a predetermined number of latest detection means outputs from the detection, calculation means for calculating information denoting correlations between the predetermined number of detection outputs stored in the storage means and for calculating a value on the basis of particular information in the correlation information, and sending means for sending the value calculated by the calculation means as information on the physical quantity of the fire phenomenon.

According to the present invention, it is possible to provide a reliable high-response fire detecting apparatus which can remove instantaneous noise components and can follow successive changes of the physical quantity of, for example, smoke or heat with respect to time, and which is not influenced by any environmental change, external noise or the like, which would otherwise cause erroneous fire information to be sent to the receiving unit, thus generating a false alarm,

DESCRIPTION OF THE PREFERRED EMBODIMENTS

Preferred embodiments of the present invention will be described below with reference to the drawings.

Figure 1:
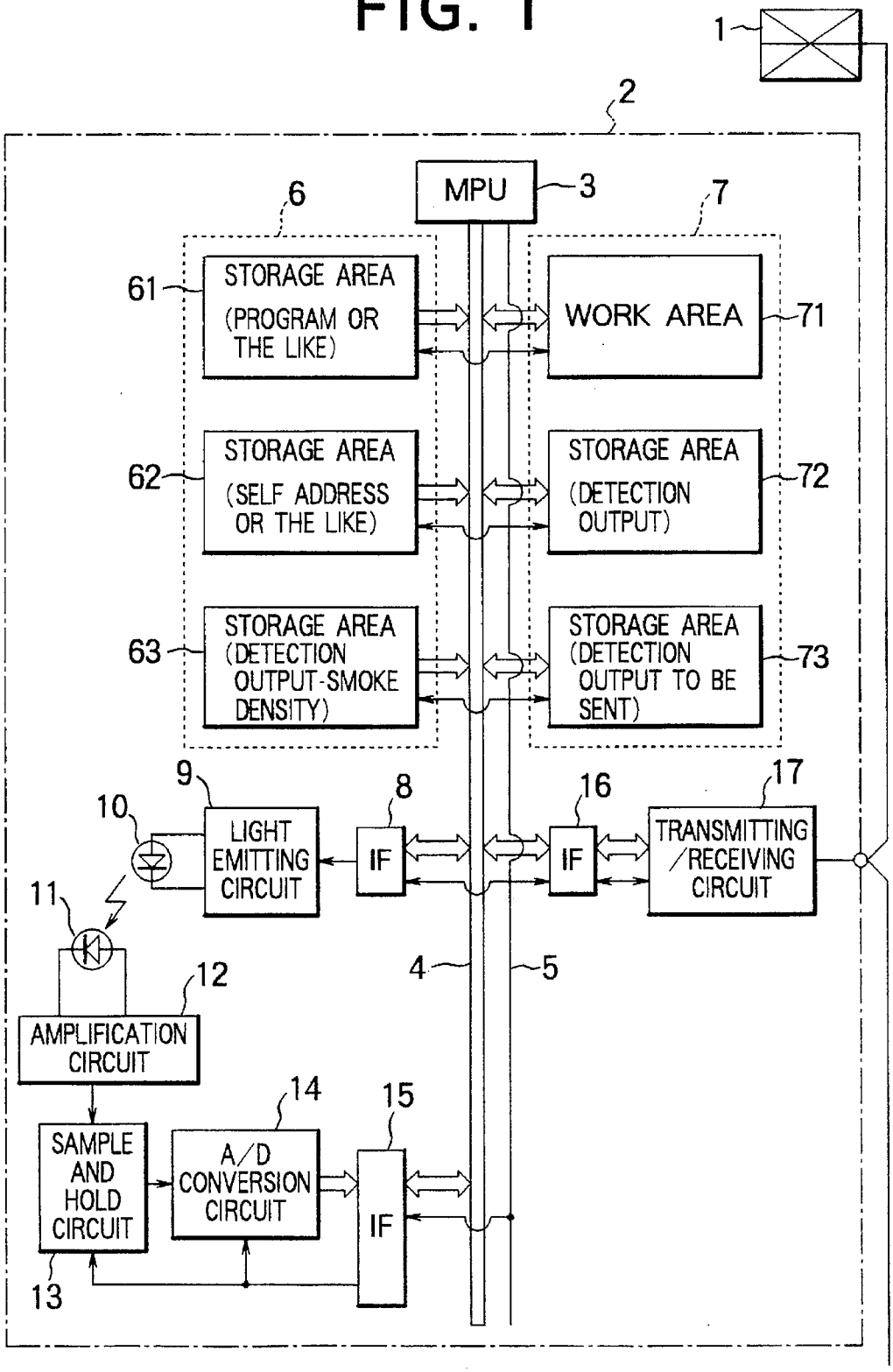
FIG. 1 is a block diagram showing a fire detecting apparatus in accordance with one embodiment of the present invention.

FIG. 1 illustrates an embodiment of the present invention in which the invention is applied to a photoelectric-type fire detector 2 such as a so-called light-scattering-type smoke-detecting fire detector.

Referring to FIG. 1, the photoelectric type fire detector 2 is connected to a receiving unit 1 such as a fire receiver or a relay unit provided in, for example, a guard room or a disaster prevention center. The photoelectric-type fire detector 2 includes a computation means in the form of a microprocessor unit 3 (hereinafter referred to as "MPU") for performing various kinds of operational processing described below, and a data bus 4 and a control bus 5 connected to the MPU 3.

Figure 2:
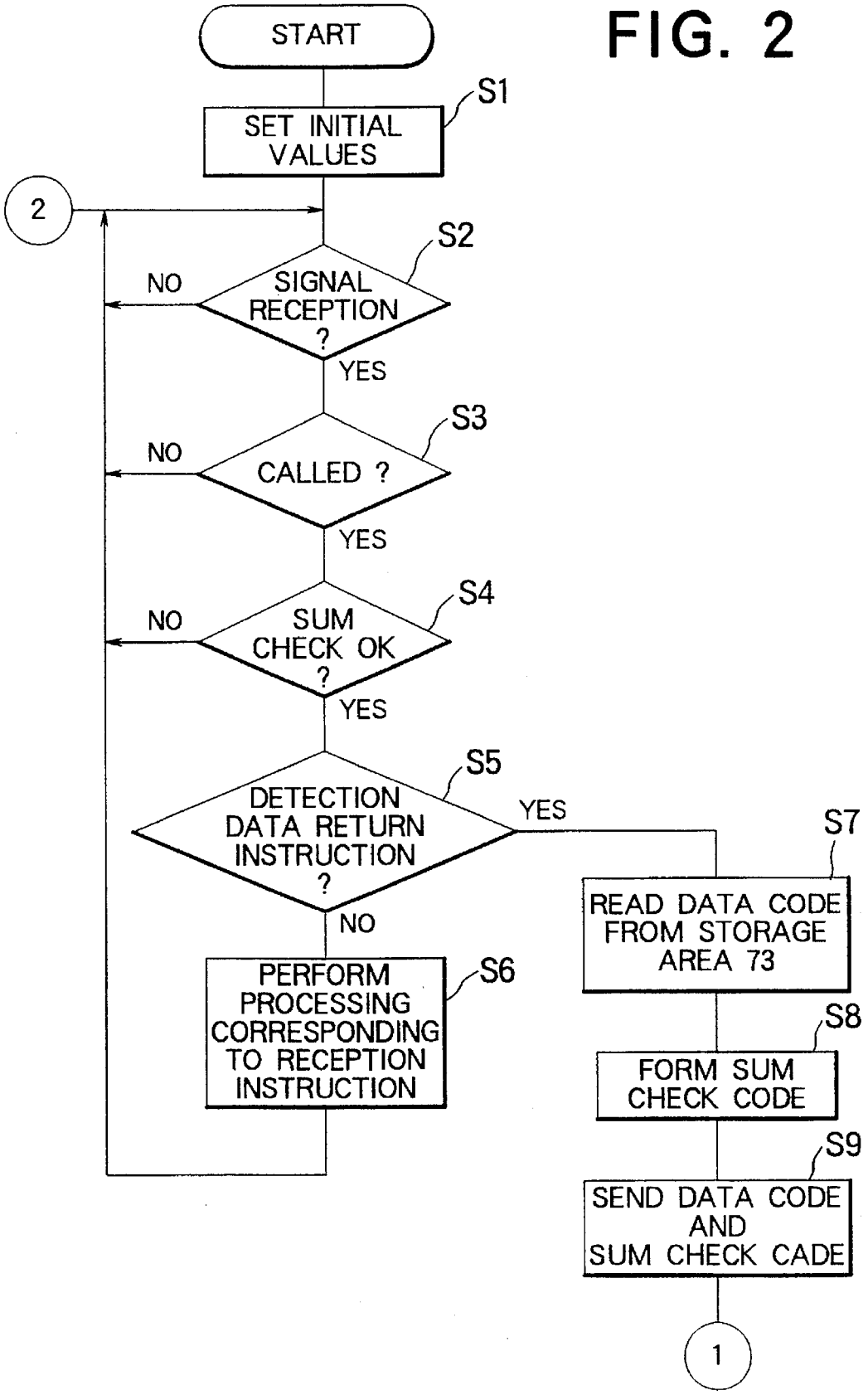
FIG. 2 is a flowchart of the operation of the arrangements shown in FIGS. 1
Figure 3:
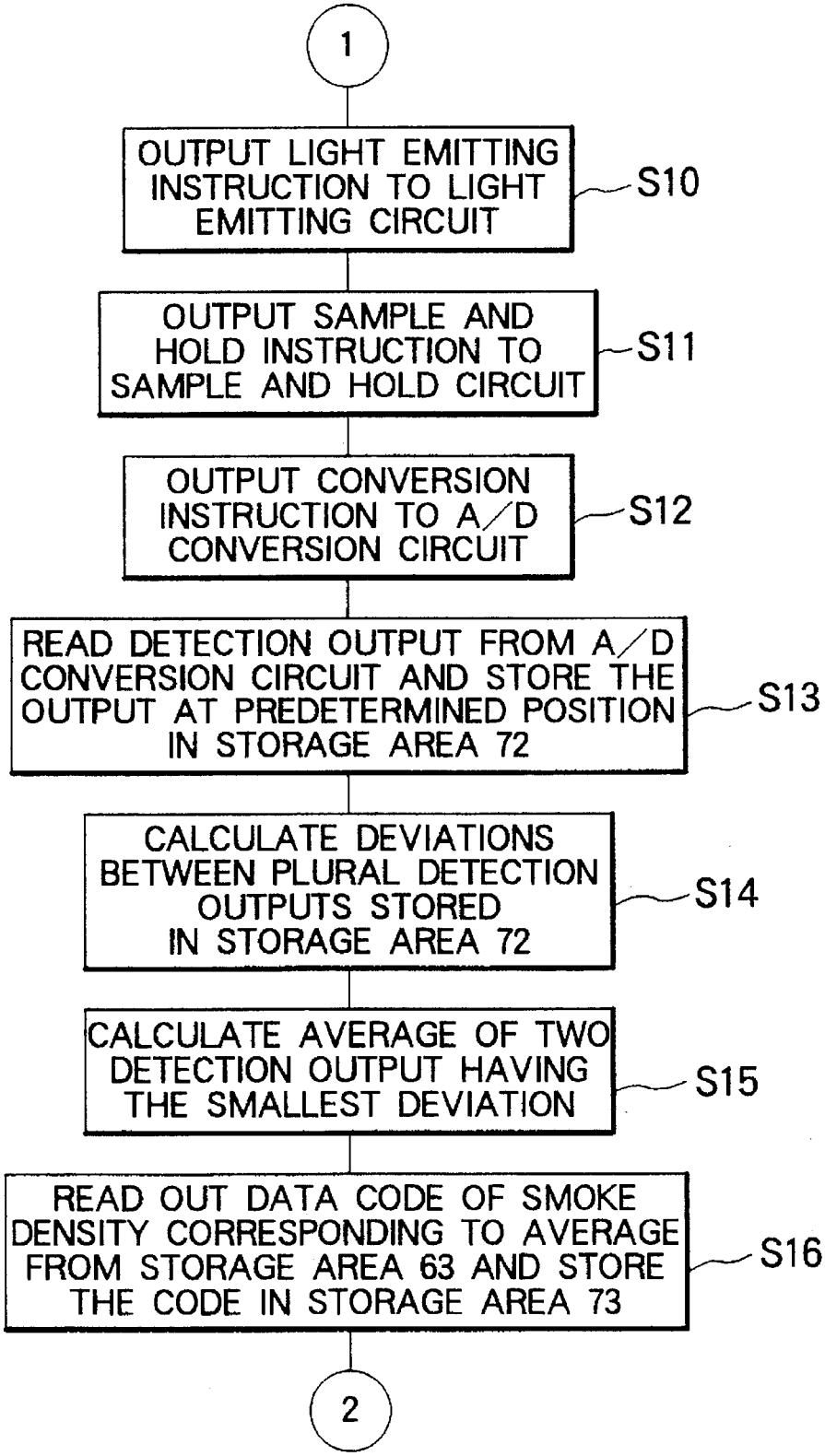
FIG. 3 is a flowchart of the operation of the arrangement shown in FIG. 1.

The photoelectric-type fire detector 2 also includes a storage means in the form of a read only memory 6 (hereinafter referred to as "ROM") connected to MPU 3 through the data bus 4 and the control bus 5. The ROM 6 has a storage area 61 where a program(s) or the like relating to the flowcharts of FIGS. 2 and 3 is previously stored, a storage area 62 where a self-address or the like is previously stored, and a storage area 63 where the relationship between detection outputs from the fire detector and a density of smoke is previously stored as a correlation table (conversion table).

The photoelectric-type fire detector 2 further includes another storage means in the form of a random access memory 7 (hereinafter referred to as "RAM") connected to the MPU 3 through the data bus 4 and the control bus 5. The RAM 7 has a work area 71 which is used when the MPU 3 performs operational processing or the like, a storage area 72 where a latest set of detection outputs from the detector obtained by performing a predetermined number of (e.g., three) detecting operations is stored, and a storage area 73 where detection data or the like to be sent to the receiving unit 1 is stored.

The photoelectric-type fire detector 2 further includes an interface 8 (hereinafter referred to as "IF") connected to the MPU 3 through the data bus 4 and the control bus 5, a light emitting circuit 9 connected to the IF 8, a light emitting device 10 such as a light emitting diode (LED) connected to the light emitting circuit 9 and driven by an output from the light emitting circuit 9, and a light receiving device 11 such as a photodiode provided in such a position as to be able to receive, through a light shield member (not shown), light of an optical output from the light emitting device 10 scattered by smoke. The light emitting device 10 is driven by the light emitting circuit 9 so as to intermittently emit light at time intervals of, for example, 2.5 to 3 seconds for a time period such that the light receiving device 11 can receive scattered light emitted from the optical output of the light emitting device 10.

The photoelectric-type fire detector 2 further includes an amplification circuit 12 for amplifying an output from the light receiving device 11, a sample and hold circuit 13 connected to the amplification circuit 12 for sampling and holding the output from the amplification circuit 12, an A/D conversion circuit 14 connected to the sample and hold circuit 13 for converting an output of the circuit 13 from analog form into digital form, an IF 15 connected between the A/D conversion circuit 14 and the data and control buses 4 and 5, an IF 16 connected to the MPU 3 through the data and control buses 4 and 5, and a transmitting/receiving means in the form of a transmitting/receiving circuit 17 which comprises a receiving circuit, a serial-parallel converter, a parallel-serial converter and a transmitting circuit (these are not shown). The components 9 to 14 together constitute a detection means.

The operation of the above-described embodiment of the invention shown in FIG. 1 will now be described with reference to FIGS. 2 to 4. Here, it is to be noted that all determinations made in the following process are carried out by the MPU 3.

First, a power supply for the fire detector 2 is turned on by the receiving unit 1 disposed in the guard room or the disaster prevention center. As shown in FIG. 2, in Step S1, initial values are set for the RAM 7, IF 8, IF 15 and IF 16. In Step S2, it is determined whether a signal is input to the transmitting/receiving circuit 17. If NO, the fire detector 2 is maintained in a standby state until it will receives a signal. Upon receipt of a signal, the process advances to Step S3 wherein a determination is made as to whether the receiving unit 1 is calling the fire detector 2, in other words, it is determined whether a reception address code received from the receiving unit 1 coincides with the address code of the fire detector 2 stored in the storage area 62.

If it is determined in Step S3 that there is no call sent to this fire detector 2, a further call is awaited. When the fire detector 2 is called, the process advances to Step S4 wherein a determination is made as to whether the result of a sum check is OK, that is, it is determined whether the sum of the reception address code and a reception instruction code is equal to a reception sum check code. If not OK, an abnormality in the reception signal is determined and the process returns to Step S2. If OK, the process advances to Step S5 to make a determination as to whether there is an instruction to return detection data. If NO, the process advances to Step S6 to perform processing in accordance with the reception instruction, for example, a function test of the fire detector 2 by increasing the amplification factor of the amplification circuit 12 and examining whether a predetermined value is reached, or by making a determination as to whether the light emitting device 10 normally emits light. The process thereafter returns to Step S2 and the above-described operations are repeated.

If there is a detection data return instruction in Step S5, the process advances to Step S7 to read from the storage area 73 of the RAM 7 a detection data code to be sent out. In Step S8, a sum check code is formed. That is, the sum of the reception address code, the reception instruction code, the reception sum check code and the detection data code is set as a sum check code.

In Step S9, the detection data code and the sum check code are sent to the receiving unit 1.

Thereafter, in Step S10 of FIG. 3, a light emitting instruction is output from the MPU 3 to light emitting circuit 9 through the control bus 5 and the IF 18, and the light emitting device 10 is driven by the light emitting circuit 9. The light emitting output is received by the receiving device 11, and the output from the receiving device 11 is amplified by the amplification circuit 12 and then supplied to the sample and hold circuit 13.

In Step S11, a sample and hold instruction is output from the MPU 3 to the sample and hold circuit 13 through the control bus 5 and the IF 15 to make the sample and hold circuit 13 hold the output from the amplification circuit 12. In Step S12, a conversion instruction is output from the MPU 3 to the A/D conversion circuit 14 via the same route to make the ND conversion circuit 14 convert the analog signal output from the sample and hold circuit 13 into a digital signal.

Thereafter, in Step S13, the MPU 3 reads a detection output from the A/D conversion circuit 14 through the data bus 4 and the IF 15 and stores the detection output at a predetermined position in the storage area 72 of the RAM 7.

Figure 4:
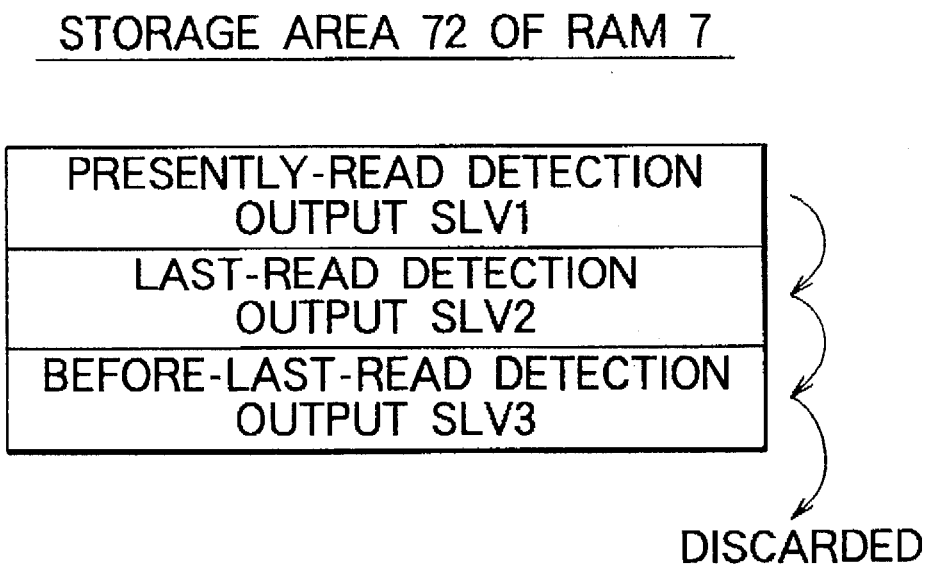
FIG. 4 is a diagram of the operation of the arrangement shown in FIG. 1.

For example, the data is stored in the storage area 72 in such a manner that the stored data is successively discarded in the order from the oldest, as shown in FIG. 4. That is, if the storage content is such that, as shown in FIG. 4, a first read detection output SLV3, a second read detection output SLV2, a third or last read detection output SLV1 are stored one after another from the lowest position, the first read detection output SLV3, which was read two times before, is discarded at the time of the next reading.

In Step S14, the MPU 3 reads out the detection output data from the storage area 72 and calculates deviations between the thus read-out detection outputs which have been successively obtained by performing a predetermined number of (e.g., three) detecting operations. That is, the absolute value of a difference between SLV1 and SLV2, the absolute value of a difference between SLV2 and SLV3 and the absolute value of a difference between SLV3 and SLV1 are respectively obtained and are temporarily stored in the work area 71 of the RAM 7.

In Step S15, the MPU 3 reads from the work area 71 a plurality of (e.g., two) detection outputs having the smallest deviation and calculates an average of the two detection outputs. That is, the average of the combination of two detection outputs having the minimum deviation.

Finally, in Step S16, the MPU 3 reads out a data code of a smoke density corresponding to the average calculated in Step S15 from the storage area 63 of the ROM 6, and stores the data code in the storage area 73 of the RAM 7.

Thereafter, the process returns to Step 2 to repeat the above-described operations.

Thus, the data stored in the storage area 73 is sent to the receiving unit 1 as a physical quantity of a present fire phenomenon, i.e., smoke in this embodiment.

In this embodiment, as described above, deviations of detection outputs obtained by performing the detecting operation three times are calculated and the average of two of the detection outputs having the smallest deviation is sent to the receiving unit as a physical quantity of smoke, which is one of present fire phenomena. It is therefore possible to remove noise components generated instantaneously and also to follow successive changes of the physical quantity of smoke with respect to time. Further, a predetermined number of object values for fire determination are rewritten at each sampling time to ensure the desired response characteristic.

Figure 5:
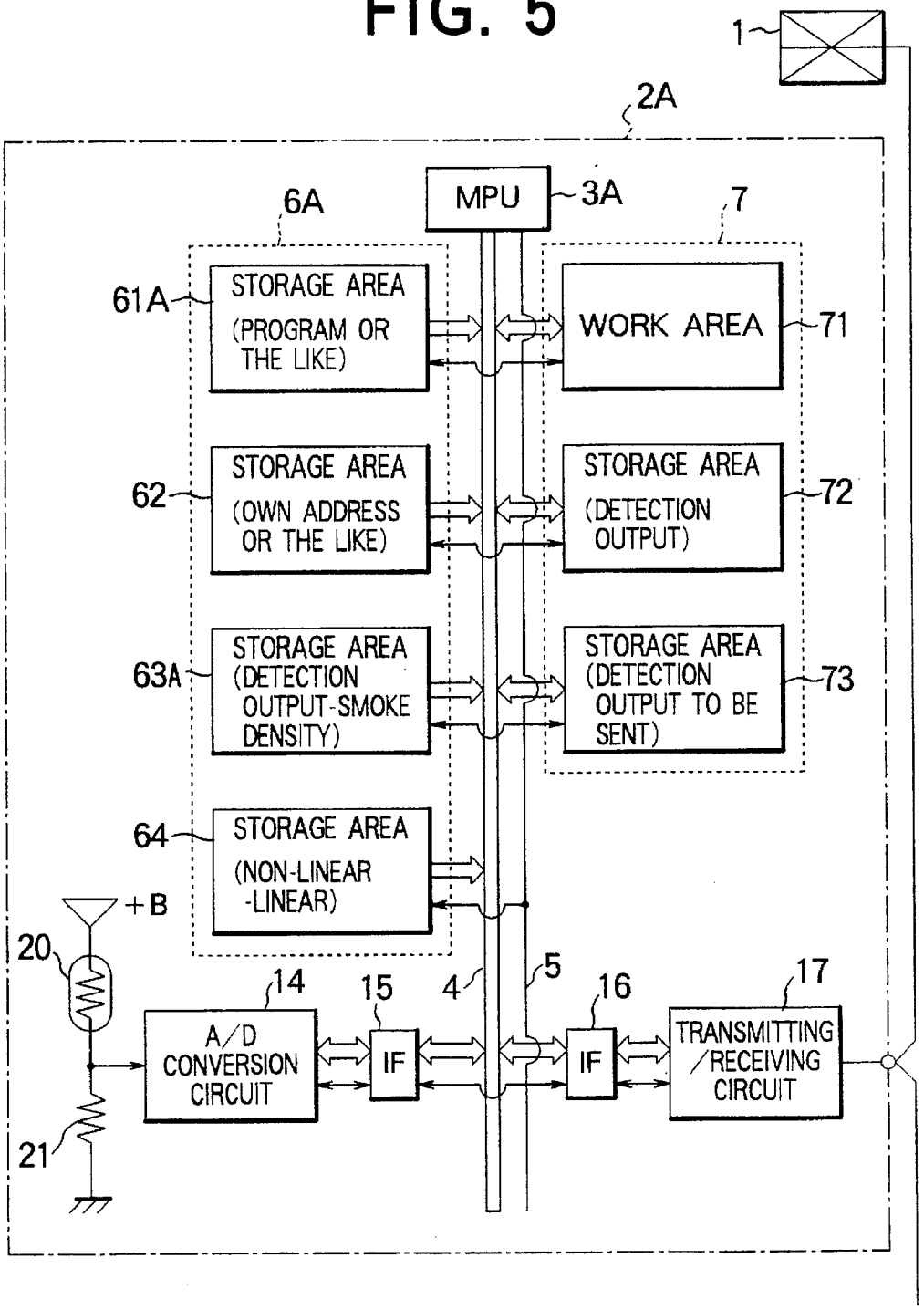
FIG. 5 is a block diagram showing a fire detecting apparatus in accordance with another embodiment of the present invention.

FIG. 5 is a block diagram showing another embodiment of the present invention in which the invention is applied to a thermal-type fire detector 2A. Components of this embodiment corresponding to those shown in FIG. 1 are indicated by the same reference symbols in FIG. 5 and will not be described in detail.

Figure 6:
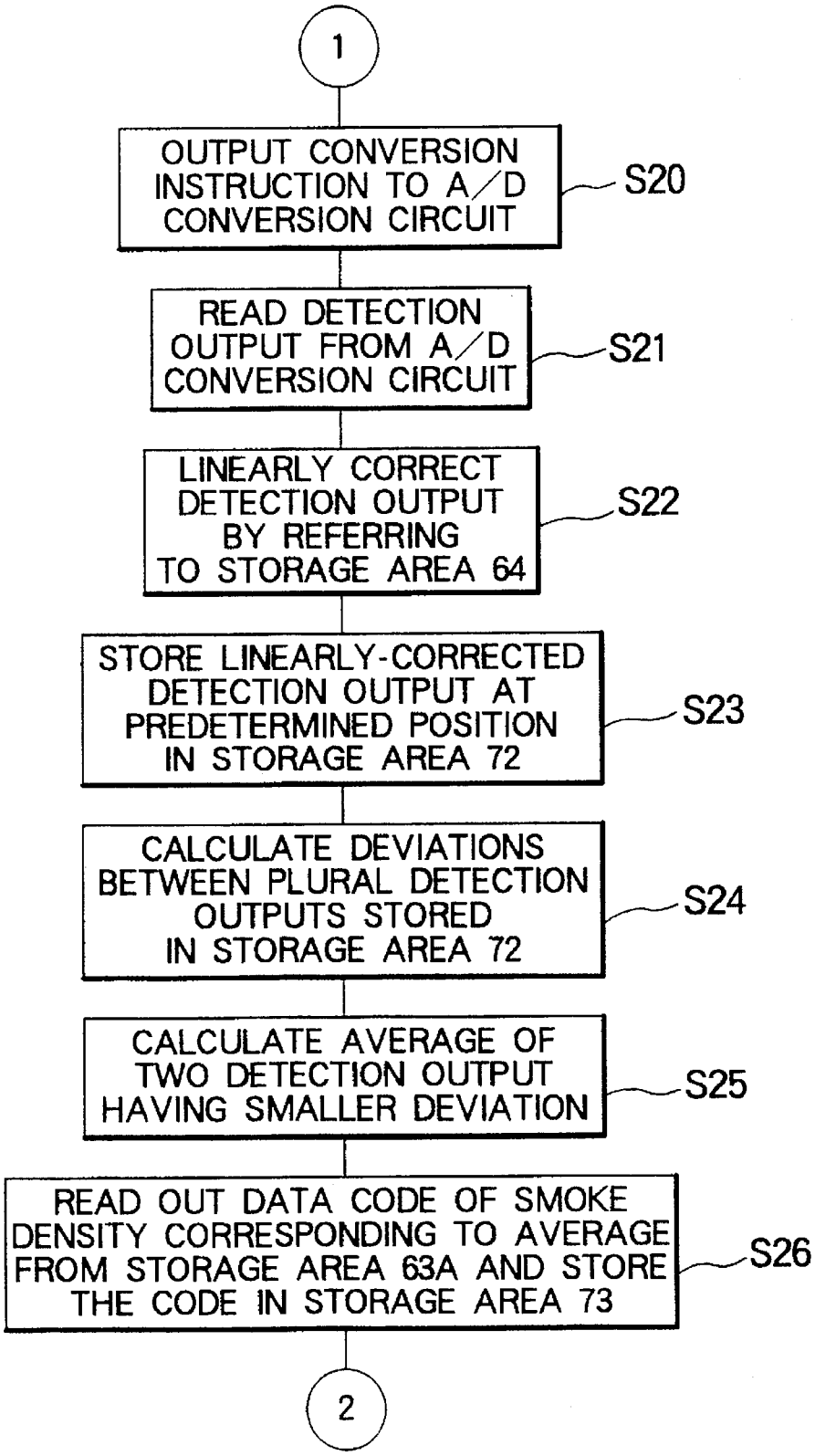
FIG. 6 is a flowchart of the operation of the arrangement shown in FIG. 5.

Referring to FIG. 5, the thermal-type fire detector 2A is connected to a receiving unit 1 and includes an MPU 3A for performing various kinds of operational processing described below, and a ROM 6A connected to the MPU 3A through a data bus 4 and a control bus 5. The ROM 6A has a storage area 61A where a program(s) or the like relating to the flowcharts of FIGS. 2 and 6 is previously stored, a storage area 62 where a self-address or the like of the fire detector 2A is previously stored, a storage area 63A where the relationship between detection outputs from the fire detector 2A and temperatures is previously stored as a correspondence table, and a storage area 64 where non-linear and linear characteristics of detection outputs from the fire detector 2A is previously stored as a correspondence table (conversion table).

The thermal fire detector 2A also includes a thermal element 20 such as a thermistor. One end of the thermal element 20 is connected to a power supply terminal B+ while the other end is grounded through a resistor 21. The point of connection between the thermal element 20 and the resistor 21 is connected to an input terminal of an A/D conversion circuit 14. The thermal element 20, the resistor 21 and the A/D conversion circuit 14 together constitute a detection means. In other respects, the construction of this embodiment is the same as that illustrated in FIG. 1.

The operation of the embodiment of the invention shown in FIG. 5 will be described with reference to FIGS. 2 and 6. In this embodiment, too, all determinations in the process described below are carried out by the MPU 3A.

First, a power supply for the fire detector 2A is turned on by the receiving unit 1 in a guard room or a disaster prevention center. In Step S1 of FIG. 2, initial values are set for the RAM 7 and other components. In Step S2, a determination is made as to whether a signal is received at the transmitting/receiving circuit 17. If NO, the fire detector 2A is maintained in a standby state until it receives a signal. Upon receipt of a signal, the process advances to Step S3 to make a determination as to whether the receiving unit 1 is calling the fire detector 2A, in other words, it is determined whether a reception address code received from the receiving unit 1 coincides with the self-address code of the fire detector 2A stored in the storage area 62.

If it is determined in Step S3 that there is no call sent to this fire detector 2A, a further call is awaited. When the fire detector 2A is called, the process advances to Step S4 to make a determination as to whether the result of a sum check is OK, that is, it is determined whether the sum of the reception address code and a reception instruction code is equal to a reception sum check code. If not OK, an abnormality of the reception signal is determined and the process returns to Step S2. If OK, the process advances to Step S5 wherein a determination is made as to whether there is an instruction to return the detection data. If NO, the process advances to Step S6 to perform processing in accordance with the reception instruction, for example, a function test of the fire detector 2A by heating the thermal element 20 with a heater (not shown) and examining whether the output of the fire detector 2A is thereby changed to a predetermined value. The process thereafter returns to Step S2 and the above-described operations are repeated.

If there is a detection data return instruction in Step S5, the process advances to Step S7 to read from the storage area 73 of the RAM 7 a detection data code to be sent out.

In Step S8, a sum check code is formed. That is, the sum of the reception address code, the reception instruction code, the reception sum check cede and the detection data code is set as the sum check code.

In Step S9, the detection data code and the sum check code are sent to the receiving unit 1.

Thereafter, in Step S20 of FIG. 6, a conversion instruction is output from the MPU 3A to the A/D conversion circuit 14 through the control bus 5 and the IF 15 to make the A/D conversion circuit 14 convert the voltage at the connection point between the thermal element 20 and the resistor 21 from analog form into digital form.

In Step S21, the MPU 3A reads a detection output from the A/D conversion circuit 14 through the data bus 4 and the IF 15 and, in Step S22, linearly corrects the detection output thus read on the basis of the correspondence table of the non-linear and linear characteristics of the detection output stored in the storage area 64 of the ROM 6A.

In Step S23, the MPU 3A stores the linearly-corrected detection output at a predetermined position in the storage area 72 of the RAM 7. The method of storing data in the storage area 72 is the same as that described above with reference to FIG. 4.

The reason for linearly correcting each detection output before obtaining deviations between the detection outputs is as follows; an ordinary thermal element such as a thermistor is so non-linear in temperature-resistance change characteristic that it is impossible to obtain accurate deviations and an accurate average from the detection outputs not corrected.

In Step S24, the MPU 3A reads out the detection output data from the storage area 72 and calculates deviations between the detection outputs which have been successively obtained by performing a predetermined number of (e.g., three) detecting operations. That is, the absolute value of a difference between SLV1 and SLV2, the absolute value of a difference between SLV2 and SLV3 and the absolute value of a difference between SLV3 and SLV1 are respectively obtained and are temporarily stored in the storage area 71 of the RAM 7.

In Step S25, the MPU 3A reads from the storage area 71 a plurality of (e.g., two) detection outputs having the smallest deviation and calculates an average of the two detection outputs. That is, the average of the combination of two detection outputs having the minimum deviation is calculated.

Finally, in Step S26, the MPU 3A reads out a data code of the temperature corresponding to the average calculated in Step S25 from the storage area 63A of the ROM 6A, and stores the data code in the storage area 73 of the RAM 7.

Thereafter, the process returns to Step 2 to repeat the above-described operations.

Thus, the data stored in the storage area 73 is sent to the receiving unit 1 as a physical quantity of a present fire phenomenon, i.e., heat in this embodiment.

In this embodiment, as described above, deviations of detection outputs obtained by performing the detecting operation three times are calculated and an average of two of the detection outputs having the smallest deviation is sent to the receiving unit as a physical quantity of heat, which is one of present fire phenomena. It is therefore possible to remove noise components generated instantaneously and also to follow successive changes of the physical quantity of heat with respect to time. Further, a predetermined number of object values for fire determination are rewritten at each sampling time to ensure the desired response characteristic.

The above embodiments have been described with respect to the method of calculating deviations of detection outputs obtained by performing the detecting operation three times and sending the average of two of the detection outputs having the smallest deviation to the receiving unit as a physical quantity of a present fire phenomenon. Essentially, any other method will suffice as long as reliable physical quantity information can be obtained. For example, the arrangement may be such that the ratios of successive two of a predetermined number of detection outputs are obtained and an average of the combination of two detection outputs having the minimum ratio is sent to the receiving unit as physical quantity information on a present fire phenomenon. The number of times the detection output is sampled for calculation of the deviations or ratios and the number of detection output values to be averaged are not limited to the above-mentioned numbers, as long as reliable physical quantity information can be obtained.

Although in the above-described embodiments, the method of using the average of the combination of two detection outputs having the minimum deviation or ratio is adopted, any other calculation method will essentially suffice as long as reliable physical quantity information can be obtained. The maximum, minimum or median value of a combination of a predetermined number of detection outputs having the smallest deviation or ratio may be used.

The above embodiments of the invention have been described with respect to the case in which data is obtained by converting an average value of detection outputs into a smoke density or a temperature by looking up the conversion table stored in the storage area 63 or 63A and is stored and sent to the receiving unit. However, the arrangement may alternatively be such that the average of detection outputs is directly stored and converted into a code signal to be sent to the receiving unit, and is converted into a smoke density or a temperature on the receiving unit side.

Also, the above embodiments have been described with respect to the case in which after a call is received from the receiving unit and a detection output is sent to the receiving unit, reading of the detection output is done. However, the arrangement may alternatively be such that the photoelectric-type fire detector or the thermal-type fire detector is provided with a timer and a detection output is read in response to an output of the timer generated at predetermined time intervals of, for example, three seconds.

In the above-described embodiments, the photoelectric-fire sensor or the thermal-type fire sensor is used in a fire detecting apparatus. However, the invention can also be applied to fire detecting apparatuses using any other fire detector, for example, an ionization-type fire detector to achieve the same effect. Further, in the above-described embodiments, a dip switch or an electrically erasable and programmable ROM may be used in place of the storage area 62, i.e., the means for storing the self-address or the like of the fire detector.

What is claimed is:

1. A fire detecting apparatus comprising:

detection means for repeatedly detecting a physical quantity of a fire phenomenon and successively outputting corresponding detection outputs according to a predetermined number of detecting operations;

storage means for successively storing a predetermined number of most recent detection outputs from said detection means;

deviation calculation means for obtaining all combinations of any two of said predetermined number of detection outputs stored in said storage means and for calculating either a deviation value or a ratio between said two detection outputs in each of said combinations;

determination means for determining which of said combinations of two detection outputs obtained by said deviation calculation means have either the smallest deviations or smallest ratios therebetween;

calculation means for calculating a detection value based on said combinations of two detection outputs determined by said determination means; and sending means for sending the detection value calculated by said calculation means as information denoting the physical quantity of the fire phenomenon.

2. A fire detecting apparatus according to claim 1, wherein said calculation means calculates an average value of the two detection outputs determined by said determination means as the detection value.

3. A fire detecting apparatus according to claim 1, wherein said calculations means calculates one of a maximum value, a minimum value and a median value of the two detection outputs determined by said determination means as the detection value.

4. A photoelectric type fire detecting apparatus comprising:

detection means for repeatedly detecting a physical quantity of smoke and successively outputting corresponding detection outputs according to a predetermined number of detecting operations;

storage means for successively storing a predetermined number of most recent detection outputs from said detection means;

deviation calculation means for obtaining all combinations of any two of said predetermined number of detection outputs stored in said storage means and for calculating either a deviation value or a ratio between said two detection outputs in each of said combinations;

determination means for determining which of said combinations of two detection outputs obtained by said deviation calculation means have either the smallest deviations or smallest ratios therebetween;

calculation means for calculating a detection value based on said combinations of two detection outputs determined by said determination means; and sending means for sending the detection value calculated by said calculation means as information denoting the physical quantity of the smoke.

5. A photoelectric type fire detecting apparatus according to claim 4, wherein said calculation means calculates an average value of the two detection outputs determined by said determination means as the detection value.

6. A photoelectric type fire detecting apparatus according to claim 4, wherein said calculations means calculates one of a maximum value, a minimum value and a median value of the two detection outputs determined by said determination means as the detection value.

7. A thermal type fire detecting apparatus comprising:

detection means for repeatedly detecting a physical quantity of heat and successively outputting corresponding detection outputs according to a predetermined number of detecting operations;

storage means for successively storing a predetermined number of most recent detection outputs from said detection means;

deviation calculation means for obtaining all combinations of any two of said predetermined number of detection outputs stored in said storage means and for calculating either a deviation value or a ratio between said two detection outputs in each combination;

determination means for determining which of the two detection outputs obtained by said deviation calculation means have either the smallest deviations or smallest ratios therebetween;

calculation means for calculating a detection value on the basis of the two detection outputs determined by said determination means; and sending means for sending the detection value calculated by said calculation means as information denoting the physical quantity of the heat.

8. A thermal type fire detecting apparatus according to claim 7, wherein said calculation means calculates an average value of the two detection outputs determined by said determination means as the detection value.

9. A thermal type fire detecting apparatus according to claim 7, wherein said calculations means calculates one of a maximum value, a minimum value and a median value of the two detection outputs determined by said determination means as the detection value.

* * * * *